United States Patent [19]

Peart

[11] 4,075,597

[45] Feb. 21, 1978

[54] VARIABLE RESISTOR WITH DUAL RATIO INPUT SHAFT

[75] Inventor: Leslie Thomas Peart, Santa Ana, Calif.

[73] Assignee: Beckman Instruments, Inc., Fullerton, Calif.

[21] Appl. No.: 752,347

[22] Filed: Dec. 20, 1976

[51] Int. Cl.[2] ..... H01C 10/16

[52] U.S. Cl. ..... 338/128; 338/131; 338/181

[58] Field of Search ..... 338/122, 123, 128–132, 338/180, 181

[56] References Cited

U.S. PATENT DOCUMENTS 3,235,827 2/1966 Baker ..... 338/174 X 3,553,626 1/1971 Kohler ..... 338/128

*Primary Examiner*—C. L. Albritton

*Attorney, Agent, or Firm*—Robert J. Steinmeyer; Ferd L. Mehlhoff; William H. May

[57] ABSTRACT

A variable resistor with a dual ratio input shaft that permits rapid and precise adjustment of the voltage or current level in an electric circuit. A single shaft operates the respective drive elements in the mechanism to provide variable control from a single control knob. The shaft is longitudinally slidable between two drive positions. One drive position allows more rapid adjustment of the resistance value for each turn of the control knob than the other drive position which permits more precise adjustment of the resistance value for each comparable turn of the control knob.

13 Claims, 5 Drawing Figures

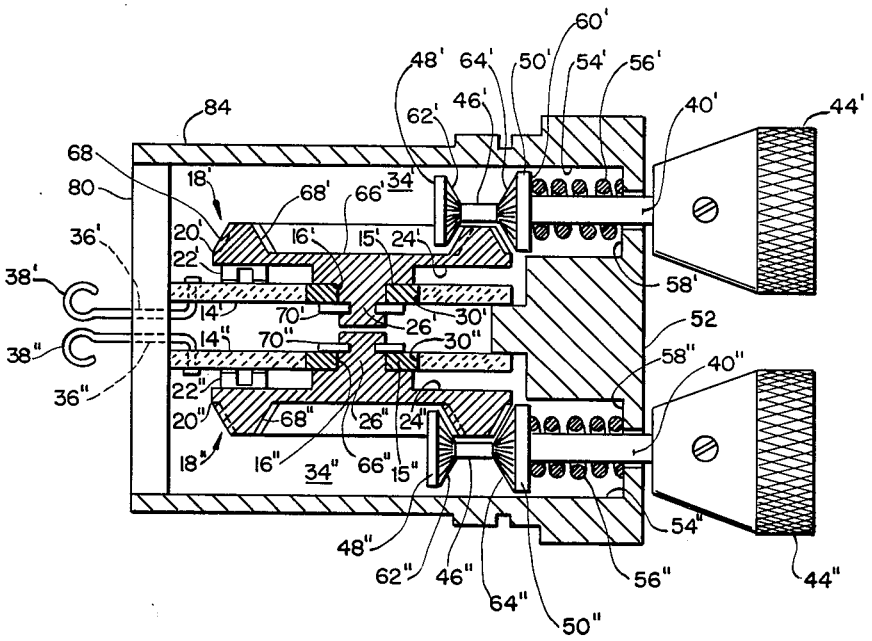
FIG. 3
FIG. 4
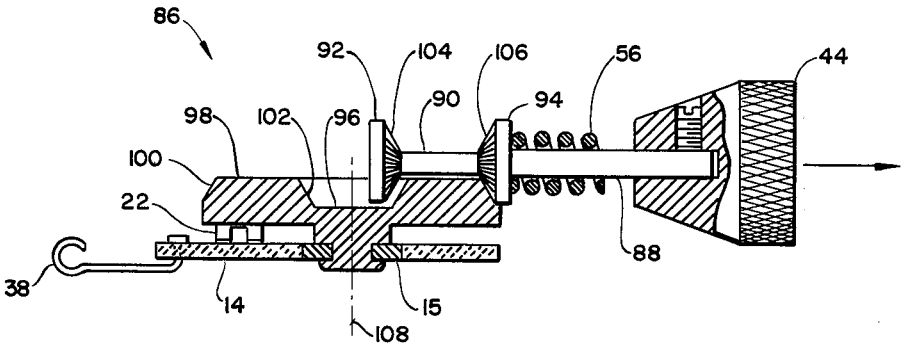
FIG. 5
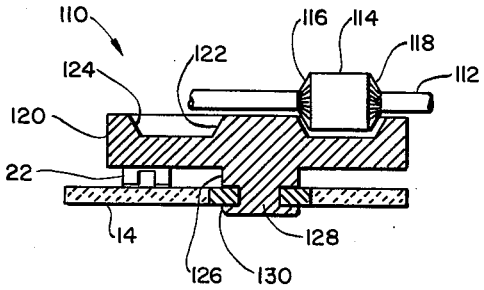

VARIABLE RESISTOR WITH DUAL RATIO INPUT SHAFT

BACKGROUND OF THE INVENTION

This invention relates to variable resistance devices and, more specifically, to control mechanisms for rapidly and precisely adjusting the resistance level within a circuit.

As known in the art, many electrical circuits require a precise control to vary the voltage and/or current. Consequently, such control is accomplished normally by making fine adjustments to the setting of a variable resistor in such electrical circuits. Typical approaches to the control of a variable resistor utilize multi-turn variable resistor arrangement, since a single turn arrangement often cannot be set with sufficient precision to satisfy the circuit requirements. Such a multi-turn resistor arrangement, however, results in a loss of efficiency and ease of operation, because a significant amount of time is required to turn the shaft the requisite number of several rotations.

Some approaches utilize an external reduction drive connected to the resistor shaft. Such an arrangement requires additional panel space and is relatively expensive to incorporate with respect to the cost of the resistor itself.

Quite often there is the need for dual controls depending upon the requirements of the electronic device. This dualism of function and controls is very common in the electronic service instruments and audio entertainment equipment. Dual controls are found on virtually all types of audio equipment to perform such a function as tone and volume controls as well as left and right loudspeaker balance controls. Further, oscilloscopes and chart recorders typically utilize a pair of variable resistors to adjust the "X" and "Y" axes trace positions. Very often these function controls are accompanied by a linear control providing a finer adjustment of the initial setting.

One approach of manufacturers has been to utilize variable resistors mounted in tandem with coaxial control shafts in order to minimize the amount of panel space required for two variable resistors. However, the utilization of this coaxial control shaft arrangement results in some frequent and annoying problems such as the inadvertent disturbance of the other common axis control when making an adjustment. This difficulty is accentuated by the fact that instrumentation designs strive to achieve a maximum compactness and, therefore, very little panel space is available and controls must frequently be positioned very closely to provide desired features within the allotted space. Consequently, when making precise control movements of the shafts, there is very often a problem of disturbing an adjacent or coaxially mounted control.

SUMMARY OF THE INVENTION

The present invention provides a unique control arrangement for a variable resistor through the use of a dual ratio input shaft to provide rapid and precise adjustment of the resistance in a circuit to set the desired level of voltage or current. The configuration of the mechanism is such that the control is contained within the body of the resistor device and, therefore, eliminates the need for additional space which is of paramount concern in a control panel for various electronic instruments and equipment. The unique design of the present invention also allows for the resistance element to be selectively interchanged by the user if it should be desirable in the construction of experimental circuits.

The control shaft is mounted within a housing for movement not only in a rotational direction, but also in a longitudinal direction. The control shaft has two slidably longitudinal positions. In the first position a turn of the control knob allows for more rapid movement of the wiper device over the resistor element than in the second position as a result of a higher driving ratio. In the second longitudinal position the control shaft provides for finer or more precise movement of the wiper device over the resistor element to give the desired exact setting. The respective driving elements which are attached to the control shaft are designed, so that their respective movement by the control shaft will result in different speeds of the wiper device over the resistor element in response to the same rotational movement of the control shaft by the control knob.

The present invention also envisions the utilization of a two resistor module contained within a single body to provide the extremely compact dual control or function module as compared to prior art ganged or tandem mounted variable resistors.

BRIEF DESCRIPTION OF THE DRAWINGS

FIG. 3 is a longitudinal sectional view of an alternate embodiment of the invention;

FIG. 4 is a longitudinal sectional view of a second embodiment of the present invention; and FIG. 5 is a partial longitudinal sectional view of a third embodiment of the present invention.

DETAILED DESCRIPTION OF THE INVENTION

Figure 1:
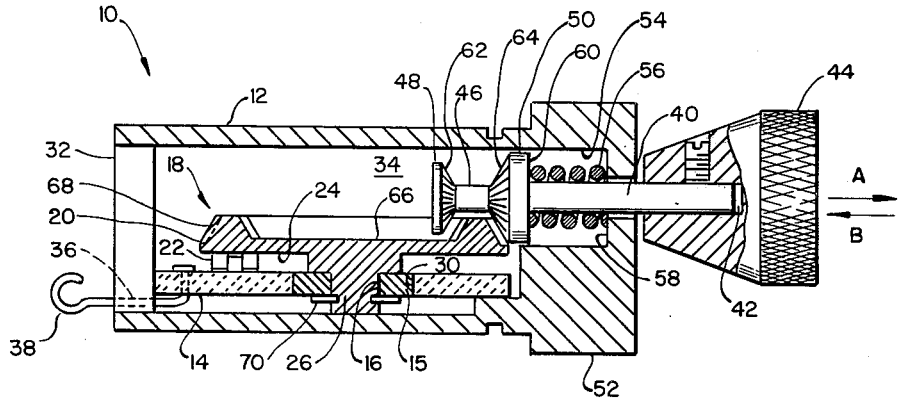
FIG. 1 is a longitudinal sectional view of the invention.

In FIG. 1 the present variable resistor invention 10 is shown having a housing 12 in which is mounted the resistance element substrate 14. Mounted within the substrate 14 is a bearing 15 having a central aperture 16 to receive the wiper mechanism or device 18 comprising the rotor 20 and the wiper 22 which is attached to the lower or bottom surface 24 of the rotor 20. The rotor shaft 26 is positioned within the aperture 16 formed within the bearing 15 located within the substrate aperture 30. It should be noted that the bearing 15 may not be necessary and the rotor shaft could be positioned within an aperture in the substrate.

One end of the housing 12 has a cover 32 having openings 36 through which extend the electrical terminals 38 which are in contact with the resistance substrate 14.

At the other end of the housing 12 there is mounted a dual ratio control member or shaft 40 having at one end 42 a control knob 44 outside the housing 12. Located adjacent the other end 46 of the control shaft 40 are a first drive element 48 and a second drive element 50. It should be noted that the control shaft 40 is mounted within an enlarged wall 52 of the housing 12. Formed within the wall 52 is a recessed area 54 coaxial with the control shaft 40. A biasing spring 56 is surmounted on the control shaft 40 within the recess 54. The biasing spring 56 is positioned between the recessed end wall 58 of the recessed area 54 and the opposing end face 60 of the second drive element 50.

Figure 2:
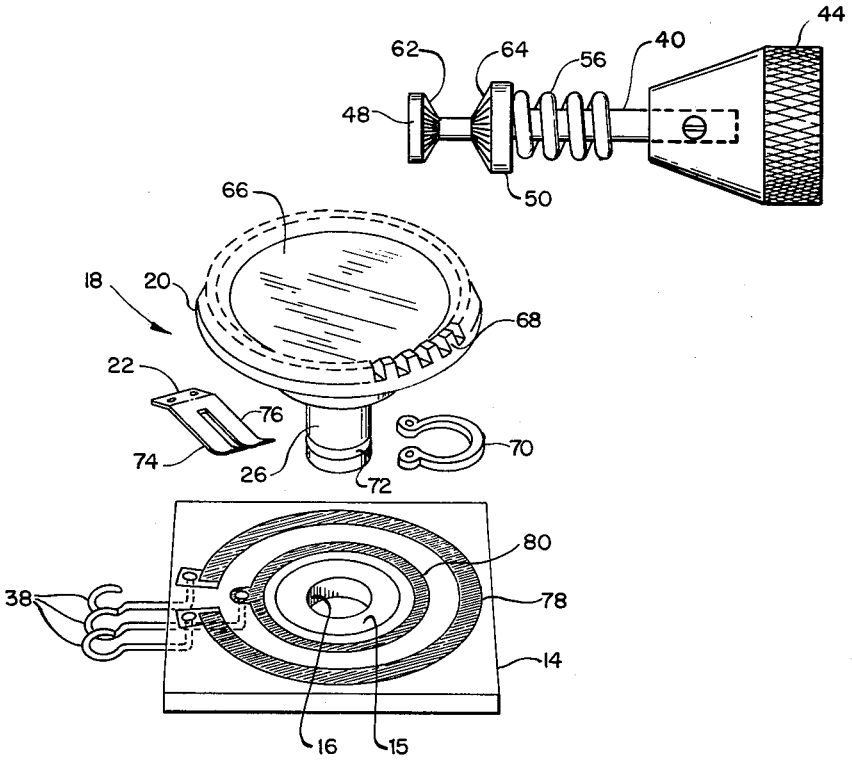
FIG. 2 is a generally exploded perspective view of the invention showing the resistance element and wiper actuating mechanism.

As shown more particularly with respect to FIG. 2, the drive elements 48 and 50 have facing beveled surfaces 62 and 64, respectively, which are spaced from each other along the control shaft and which contain a plurality of gear teeth. Located on the engaging surface 66 of the rotor 20 are a plurality of raised beveled gear teeth 68 which are designed to engage with the gear teeth 62 of drive element 48 or gear teeth 64 of drive element 50. As shown in FIG. 1, the beveled gear teeth 62 and 64 of the respective drive elements 48 and 50 are designed to be positionable between the beveled gear teeth 68 of rotor 20.

As shown in FIGS. 1 and 2, the rotor shaft 26 is positioned in the aperture 16 of the bearing 15. Further, a keeper spring 70 is positioned within a groove 72 in the rotor shaft 26 beneath the substrate 14 to maintain the position of the rotor shaft within the substrate 14.

The wiper 22 in FIG. 2 is comprised of two wiper contacts 74 and 76 which respectively engage the resistance track 78 and the pick-off track 80. Electrical terminals 38 are connected to the respective resistance track 78 and the pick-off track 80.

As shown in FIG. 1 the control shaft 40 is normally biased by spring 56 in a position with the second drive element 50 contacting the gear teeth 68 of the rotor 20. Since the control shaft is movable not only radially, but also axially, as shown with respect to the arrows A and B in FIG. 1, the gear teeth of either the first drive element 48 or the gear teeth of second drive element 50 can be engaged with the gear teeth 68 of the rotor 20 depending upon the longitudinal position of the control shaft 40. Since there are fewer teeth in the smaller first drive element 48 than the number of teeth in the larger drive element 50, radial movement of the control knob 44 when the drive element 48 is engaged with the rotor teeth 68 will cause a more rapid rotation of the wiper 22 than when the larger drive element 50 is engaged with the rotor teeth 68. Rotation of the control knob 44 with drive element 50 engaged will cause less rapid, but more precise movement of the wiper element 22.

In other words, for every rotation of the control knob 44 the rotor 20 with the wiper element 22 will rotate more when drive element 48 is engaged with the rotor teeth 68 than when drive element 50 is engaged with the rotor teeth 68. Therefore, the single control shaft 40 provides a selection of two ratios for the amount of wiper movement to the amount of control knob rotation.

Turning to the more specific discussion of the operation of the present invention, reference is made to FIG. 1. As stated previously, when the dual ratio control shaft 40 is in its unattended position, the biasing spring 56 retains the control shaft in one of its longitudinal positions where the larger drive element 50 engages the rotor teeth 68. However, as a first step in adjusting the resistance value to control the voltage or current in a circuit, the control knob 44 is grasped and pulled in the direction of the arrow A against the bias of the spring 56 to the position where the small drive element 48 with its teeth 62 engages the rotor teeth 68. While held against the bias of the spring 56, the control knob 44 is rotated to provide a more rapid and responsive traversal of the wiper element 22 on the resistor element to adjust the resistance as required to change the desired voltage or current in the circuit. The second step in the adjustment of the resistance to precisely set the resistance is accomplished by releasing the control knob 44 to allow the biasing spring 56 to move the control knob 44 in a direction of the arrow B, forcing the drive element 48 out of engagement with the rotor teeth 68 and placing the drive element's 50 teeth 64 into engagement with the rotor teeth 68. At this point any rotational movement of the control knob 44 will provide a precise adjustment to the movement in the wiper element 22, since there are more teeth 64 in the larger drive element 50.

An alternate embodiment of the present invention is shown in FIG. 3 having two dual ratio input shaft variable resistor devices in a single enclosed housing 84. All of the elements of these dual ratio variable resistors are the same as those set forth in FIGS. 1 and 2 and are respectively numbered with a prime and double prime on the same numerals. The operating principles of these similarly constructed dual input ratio shaft variable resistors is the same as that discussed above with respect to the arrangement shown and described in FIGS. 1 and 2.

In FIG. 4 a second alternate embodiment 86 of the present invention is shown having a dual ratio input shaft or control shaft 88 having at one end 90 a first drive member 92 and a second drive member 94. Positioned in juxtaposed relation to the one end 90 of the control shaft 88 is the rotor 96 having a protruding interface portion 98. The interface portion 98 has an outer friction surface 100 and an inner friction surface 102. All of the other elements in the alternate embodiment 86 in FIG. 4 are the same as that shown with respect to FIGS. 1 and 2. It should be noted that the drive elements or members 92 and 94, respectively, have similar shaped and configured friction drive surfaces 104 and 106 respectively. Instead of utilizing the engagement of gear teeth as in the drive elements 48 and 50 and rotor 20 in FIG. 1, the friction driving surfaces 104 and 106 on the respective members 92 and 94 in FIG. 4 are designed to engage the friction surfaces 102 and 100, respectively, on the rotor 96. The operation of the dual ratio input shaft or control shaft 88 in FIG. 4 is the same as control shaft 40 with respect to FIG. 1. However, the more rapid traversal of the wiper element 22 by the engagement of the drive member 92 with the rotor 96 is the result of the radius of the inner friction driving surface 102 of the rotor 96 being smaller than the radius of the outer bearing surface 100 of the rotor 96 with respect to the axis 108 of the rotor 96.

The operation of embodiment 10 shown in FIG. 1 is based upon the fact that there are fewer gear teeth in the drive member 48 than the number of gear teeth in the drive member 50. On the other hand, the operation of the embodiment 86 in FIG. 4 is based upon the fact that the radius from the rotative axis 108 of the rotor 96 to the inner bearing surface 102 is smaller than the radius to outer bearing surface 100 of the rotor 96 causing the more rapid movement of the rotor 96 when the drive element 92 is engaged with the rotor 96 than when the drive member 94 is engaged with the rotor 96 and for the same comparable rotation of the control knob 44.

A third embodiment 110 of the present invention is shown in FIG. 5 wherein the dual ratio input control shaft 112 has a single drive element 114 having a first drive face 116 and a second drive face 118 which can be comprised of either gears or a frictional surface. Further, the rotor 120 has an interior recessed inverted frustoconical bearing surface 122 and an outer recessed inverted frustoconical bearing surface 124. Consequently, when the driving surface 116 of the drive member 114 engages the inner bearing surface or gear surface 122 of the rotor 120 there will be a more rapid movement of the rotor and the respective wiper element 22 when the control knob 44 (not shown) is turned as compared to when the drive surface 118 is in engagement with the frictional surface 124. When the drive surface 118 is in engagement with the outer bearing surface 124 of the rotor 120, the movement of the wiper element 22 will be slower to allow more precise and controlled adjustment of the resistance. FIG. 5 also shows an alternate way of retaining the rotor shaft 126 within the substrate 14, by upsetting the end 128 of the rotor shaft to form a button 130. This can be accomplished by ultrasonic staking, heat staking, or friction staking. Otherwise, the third embodiment shown in FIG. 5 has all the same or similar constructive features and elements as shown in the embodiment 10 of FIGS. 1 and 2.

While various embodiments of the invention have been described above, it will be apparent to those skilled in the art that various modifications in the structure and/or composition of one or several of the features described may be made. It will be appreciated by those skilled in the art that various improvements, modifications, may be made in some or all these features without departing from the spirit and scope of the invention.

What is claimed is:

1. A variable resistor apparatus comprising:

a housing;

a resistor element mounted on one surface in said housing;

a wiper device rotatably mounted in said housing;

a contact member on said wiper device in contacting relation to said resistor element;

a control member positioned in said housing with one end of said control member adjacent said wiper device, said control member movable to move said contact member relative said resistor element;

a first drive surface positioned on said one end of said control member;

a second drive surface positioned on said one end of said control member in spaced relation to said first drive surface, one of said first and second drive surfaces being closer to the center of said wiper device than the other of said first and second drive surfaces; and means on said wiper device acting in selective cooperation with one of said first and second drive surfaces for changing the ratio of movement of said contact member with respect to a constant movement of said control member.

2. A variable resistor apparatus as defined in claim 1 wherein said control member comprises:

an axially rotatable shaft; and a control knob connected to the other end of said shaft which is outside of said housing, said control knob facilitating the axial rotation of said shaft to turn said wiper device.

3. A variable resistor apparatus as defined in claim 2 wherein said control member additionally comprises a biasing member in contacting relation with said shaft, said control shaft being longitudinally slidable relative said housing between a first and a second position, said biasing member maintaining said shaft in one of said first and second positions.

4. A variable resistor apparatus as defined in claim 1 wherein said wiper device comprises:

a rotor mounted adjacent said resistor element, said rotor movable relative said resistor element; and a wiper element connected to said rotor and in sliding contact with said resistor element, said changing means receivably and selectively mating with said first and second drive surfaces to cause the rotation of said rotor and movement of said wiper element in response to said control member.

5. A variable resistor apparatus as defined in claim 4 wherein said changing means comprises a series of raised beveled gear teeth forming two circular gear surfaces on opposite sides of said raised gear teeth and wherein said first and second drive surfaces have mating drive gear teeth.

6. A variable resistor apparatus as defined in claim 5 wherein one of said first and second drive surfaces has more gear teeth than the other of said first and second drive surfaces to provide more movement of said rotor in response to the same rotation of said control member when said control member is in one of said first and second positions than when said control member is in the other of said first and second positions.

7. A variable rcsistor apparatus as defined in claim 5 wherein said gears on said first and second drive surfaces are beveled.

8. A variable resistor apparatus as defined in claim 4 wherein said changing means is at least two frictional surfaces and wherein said first and second drive surfaces have friction surfaces for mating with respective frictional surfaces of said changing means.

9. A variable resistor apparatus as defined in claim 1 wherein said first and second drive surfaces are beveled and said changing means has mating beveled surfaces for engaging receipt of said first and second drive surface respectively, said beveled surfaces of said first and second drive surfaces facing each other in spaced relation along said control member.

10. A variable resistor apparatus as defined in claim 1 wherein said first and second drive surfaces are in spaced relation to each other along said control member, one of said first and second drive surfaces engaging said changing means and the other of said first and second drive surfaces disengaged from said changing means when said control member is in one of said first and second positions, said other of said first and second drive surfaces engaging said changing means and said one of said first and second drive surfaces disengaged from said changing means when said control member is in the other of said first and second positions.

11. A dual ratio variable resistor comprising:

a housing;

a resistor element positioned within said housing;

a wiper device movably mounted in contacting relation to said resistor element;

an elongated control member movably mounted in said housing and having one end positioned adjacent said wiper device;

means for controlling the movement of said control member;

a first drive surface positioned on said one end of said control member; and a second drive surface positioned on said control member and spaced from said first drive surface, said control member movable between a first and a second longitudinal position, one of said first and second drive surfaces engaging said wiper device and the other of said first and second drive surfaces not engaging said wiper device when said control member is in one of said first and second positions, said other of said first and second drive surface engaging said wiper device and said one of said first and second drive surfaces not engaging said wiper device when said control member is in the other of said first and second positions, one of said first and second drive surfaces being smaller than the other of said first and second drive surfaces so that said one of said first and second drive surfaces causes more movement of said wiper device than the other of said first and second drive surfaces for the same amount of movement of said controlling means.

12. A variable resistor apparatus comprising:

a housing;

a resistor element mounted within said housing;

a wiper device in movable contacting relation with said resistor element;

a first drive surface adjacent said wiper device;

a second drive surface adjacent said wiper device and spaced from said first drive surface means positioned within said housing and connected to said first and second drive surfaces for moving said wiper device and for adjusting the position of said first and second drive surfaces with respect to said wiper device, said first and second drive surfaces being differently sized and differently positioned with respect to said wiper device so that movement of said wiper device by said first drive surface will cause a different rate of movement in said wiper device than movement of said wiper device by said second drive surface with respect to a constant movement of said moving and adjusting means.

13. A multiple dual ratio resistor assembly comprising:

a housing;

at least a pair of resistor elements mounted within said housing;

a wiper device movably mounted adjacent each of said resistor elements;

at least two elongated control members, each positioned adjacent one of said wiper device;

a control knob on each of said control members to allow adjusting rotational movement of each of said control members;

a first driving member mounted on each of said control members; and a second driving member mounted on each of said control members spaced from each of said first driving members, said control members movable between a first and a second slidable position, one of said first driving members of one of said control members being in driving engagement with one of said wiper devices and said second driving member of said one of said control members being out of engagement with said one of said wiper devices when said one of said control members is in said first position, one of said second driving members of said one of said control members being in driving engagement with one of said wiper devices and said first driving member of said one of said control members being out of engagement with said one of said wiper devices when said one of said control members is in said second position, each of said first driving members being sized and positioned different than said second driving members, so that the same amount of rotational movement of the control member will cause more movement of said wiper device when said control element is in one of said first and second positions than when in the other of said first and second positions.

* * * * *